US007014045B2

(12) United States Patent
Lin

(10) Patent No.: US 7,014,045 B2
(45) Date of Patent: Mar. 21, 2006

(54) COSMETIC COMPACT

(75) Inventor: Ching-lang Lin, Hsin Chu (TW)

(73) Assignee: Rexam Der Kwei Cosmetic Packaging Ltd., (TW)

( * ) Notice: Subject to any disclaimer, the term of this patent is extended or adjusted under 35 U.S.C. 154(b) by 461 days.

(21) Appl. No.: 10/278,613

(22) Filed: Oct. 22, 2002

(65) Prior Publication Data

US 2003/0205236 A1 Nov. 6, 2003

(30) Foreign Application Priority Data

May 6, 2002 (TW) ..... 91206421 U

(51) Int. Cl.
*A45D 33/24* (2006.01)

(52) U.S. Cl. ..... 206/581; 132/300; 132/294

(58) Field of Classification Search ..... 132/293, 132/295, 300, 294; 220/4.22, 4.24, 23.83, 220/23.87, 23.86, 23.89, 816, 820, 822, 324, 220/326, 506, 507, 553, 555; 206/581, 371, 206/373

See application file for complete search history.

(56) References Cited

U.S. PATENT DOCUMENTS

| | | | | | |
|---|---|---|---|---|---|
| 343,073 | A * | 6/1886 | Seefels | 190/109 |
| 1,774,767 | A * | 9/1930 | Smith | 132/294 |
| 1,883,793 | A * | 10/1932 | Rudolph | 132/300 |
| 1,959,629 | A * | 5/1934 | Nathan et al. | 132/297 |
| 2,078,096 | A * | 4/1937 | Parkin | 220/523 |
| 3,185,338 | A * | 5/1965 | Henning | 220/318 |
| 4,717,024 | A * | 1/1988 | Djezovic | 206/581 |
| 5,676,240 | A * | 10/1997 | Cziraky et al. | 206/1.7 |
| 6,843,385 | B1 * | 1/2005 | Gardi | 220/4.22 |

* cited by examiner

*Primary Examiner*—Kevin Shaver
*Assistant Examiner*—Stephanie Willatt
(74) *Attorney, Agent, or Firm*—Martine Penilla & Gencarella, LLP

(57) ABSTRACT

A cosmetic compact includes a base member, a pair of covers having a first cover and a second cover, and the first cover and the second cover are pivotally connected to the base member. A plurality of flexible members are attached to both sides of the base member, and at least one latch structure is formed on the pair of covers.

7 Claims, 4 Drawing Sheets

COSMETIC COMPACT

BACKGROUND OF THE INVENTION

1. Field of the Invention

The present invention relates to a cosmetic compact and, more particularly, to a cosmetic compact that can be properly opened by a single hand.

2. Description of the Related Art

FIG. 1 is a perspective view showing a conventional cosmetic compact 100. As shown in FIG. 1, the conventional cosmetic compact 100 includes a base member 101 and a cover 102 pivotally connecting to the base member 101 by means of hinge pins (not shown). Lip 103 is integrally formed on push button 105 that is on the forward edge of base member 101, and latch 104 is formed on the forward edge of cover 102. The latch 104 hooks with lip 103 to maintain a close joint between the base member 101 and the cover 102. When cover 102 is in a closed position, a user must press the push button 105 with that lip 103 slips off the latch 104 so as to open the conventional cosmetic compact 100. Thus, upon using the conventional cosmetic compact 100, a user must hold the base member 101 with one hand while open the cover 102 with the other hand. Consequently, it is not convenient for a user to use the conventional cosmetic compact 100. Therefore, it is desirable to design a cosmetic compact that can be properly opened just by a single hand.

SUMMARY OF THE INVENTION

It is therefore an object of the invention to provide a cosmetic compact that can be properly opened by a single hand. By doing so, a user can use a cosmetic compact in a more convenient way.

To achieve the object mentioned above, the invention provides a cosmetic compact including a base member and a pair of covers pivotally connected to the base member, and a plurality of flexible members attached to both sides of the base member. Further, at least one latch structure is formed on the pair of covers.

According to an embodiment of the present invention, the base member has a plurality of recesses and the plurality of flexible members are leaf springs.

Further, both sides of the base member can be formed with notches for accommodating flexible members when the flexible members are compressed by the side walls.

Also, a raised portion is formed on the pair of covers where the latch structure is formed.

Further, the flexible members and the latch structure can be integrally formed on the base member and the pair of covers respectively.

When the latch structure slides out of engagement, flexible members that are formerly compressed are released and thus a resilient force is produced and acts upon the side walls of the covers, which allows the cosmetic compact to be opened. Due to the fact that the flexible members coact with the latch structure and the covers are configured in pair, the cosmetic compact can be properly opened by a single hand. Therefore, it is convenient for a user to use the cosmetic compact of the invention.

DETAILED DESCRIPTION OF THE PREFERRED EMBODIMENT

A cosmetic compact in accordance with the preferred embodiment of the invention will be described with reference to the accompanying drawings.

Figure 1:
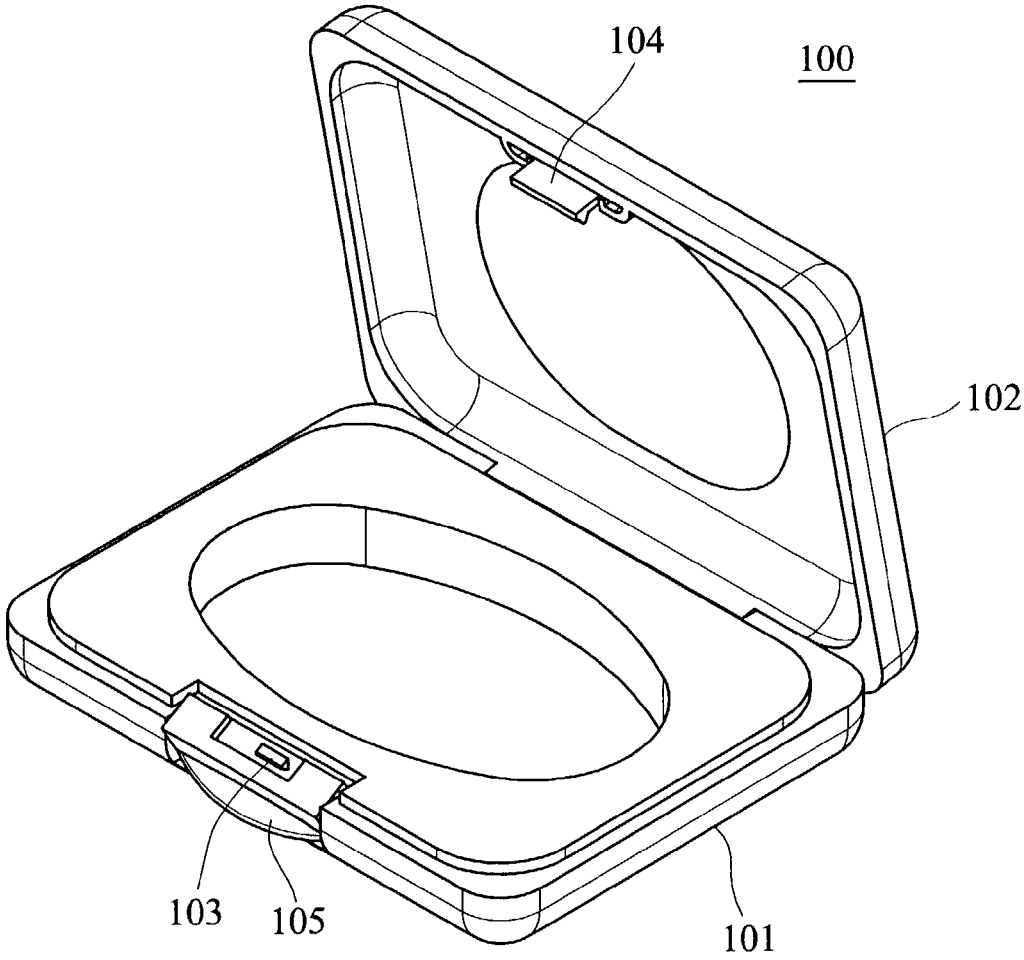
FIG. 1 (PRIOR ART)
FIG. 1 is a perspective view showing a conventional cosmetic compact.
Figure 2:
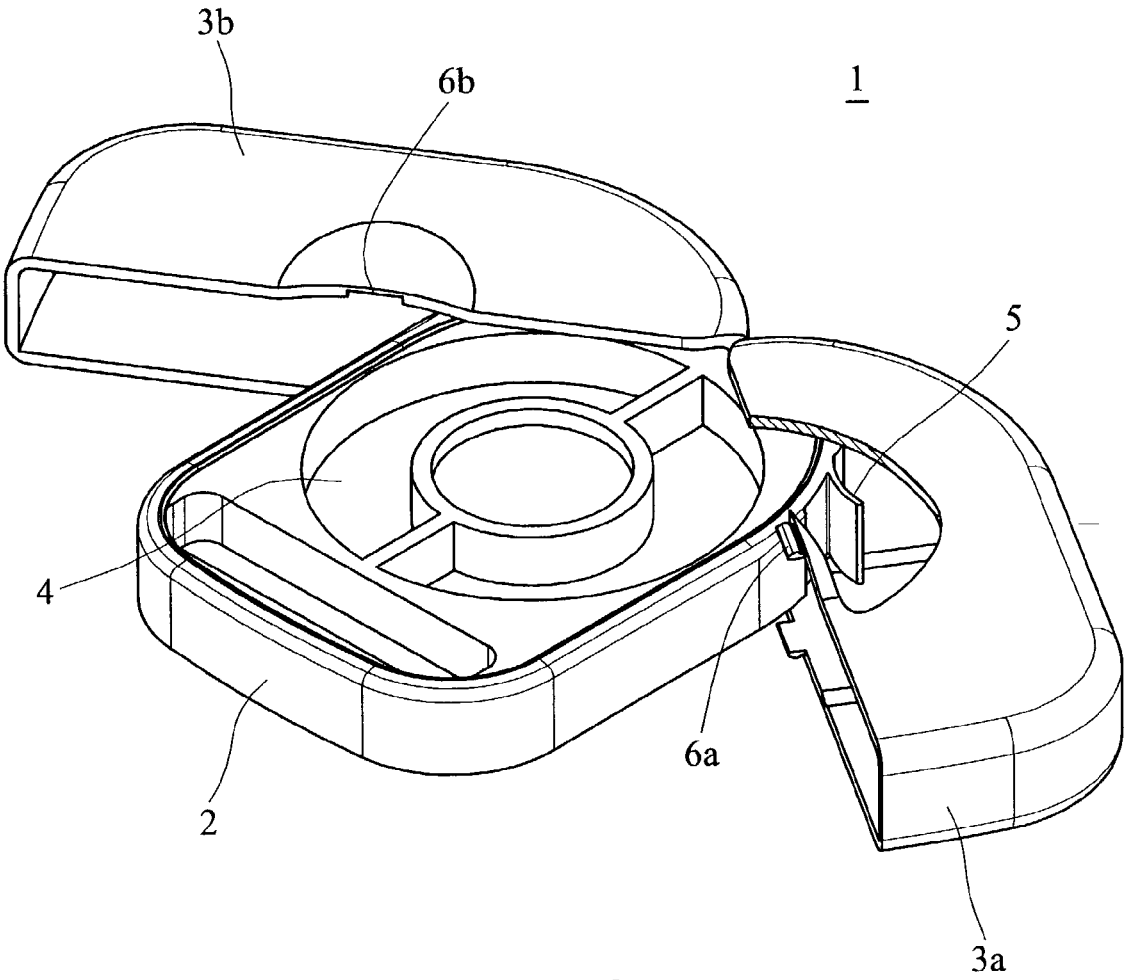
FIG. 2 is a perspective view showing a cosmetic compact according to an embodiment of the invention.

Referring to FIG. 2, cosmetic compact 1 includes a base member 2 and a pair of covers 3 having a first cover 3*a* and a second cover 3*b*. The first cover 3*a* and the second cover 3*b* are pivotally connected to the base member 2. The base member 2 has a plurality of recesses 4 for receiving, for example, a mirror, powder, or eye shadow. A latch structure including a first hook 6*a* and a second hook 6*b* is formed on the edges of covers 3. When cosmetic compact 1 is closed, the first hook 6*a* and the second hook 6*b* contact with each other so as to fasten the first cover 3*a* and the second cover 3*b*. On both sides of the base member 2 are provided with flexible members 5 such as leaf springs.

Figure 3:
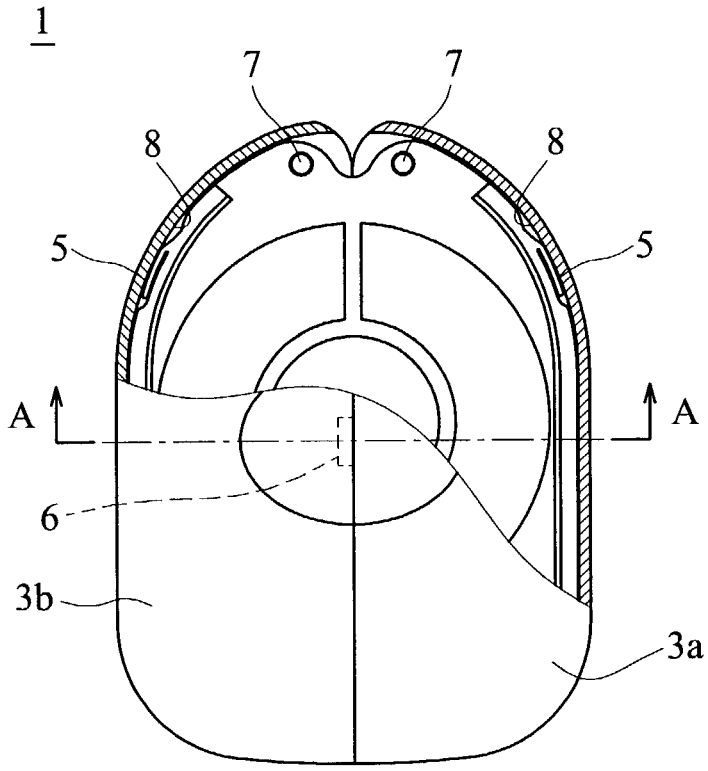
FIG. 3 is a top partially sectional view showing a closed state of the cosmetic compact according to the embodiment of the invention.
Figure 4:
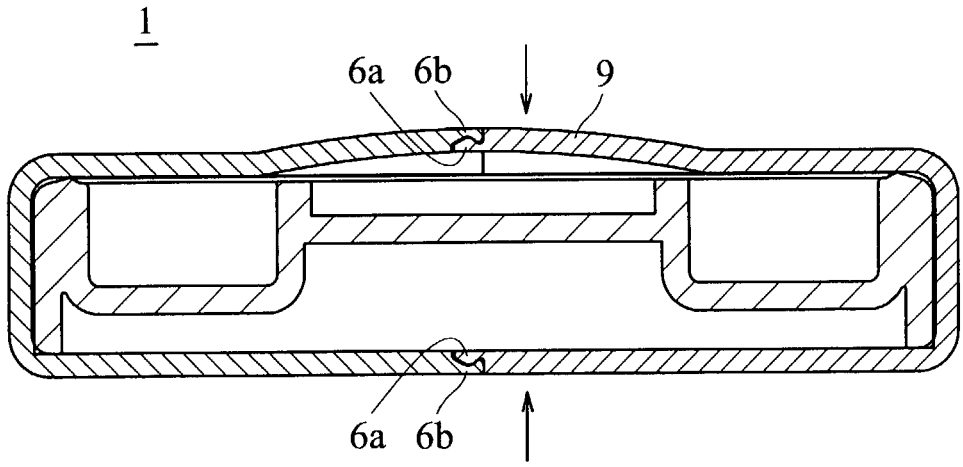
FIG. 4 is an enlarged cross-sectional view along line "A—A" in FIG. 3.
Figure 5:
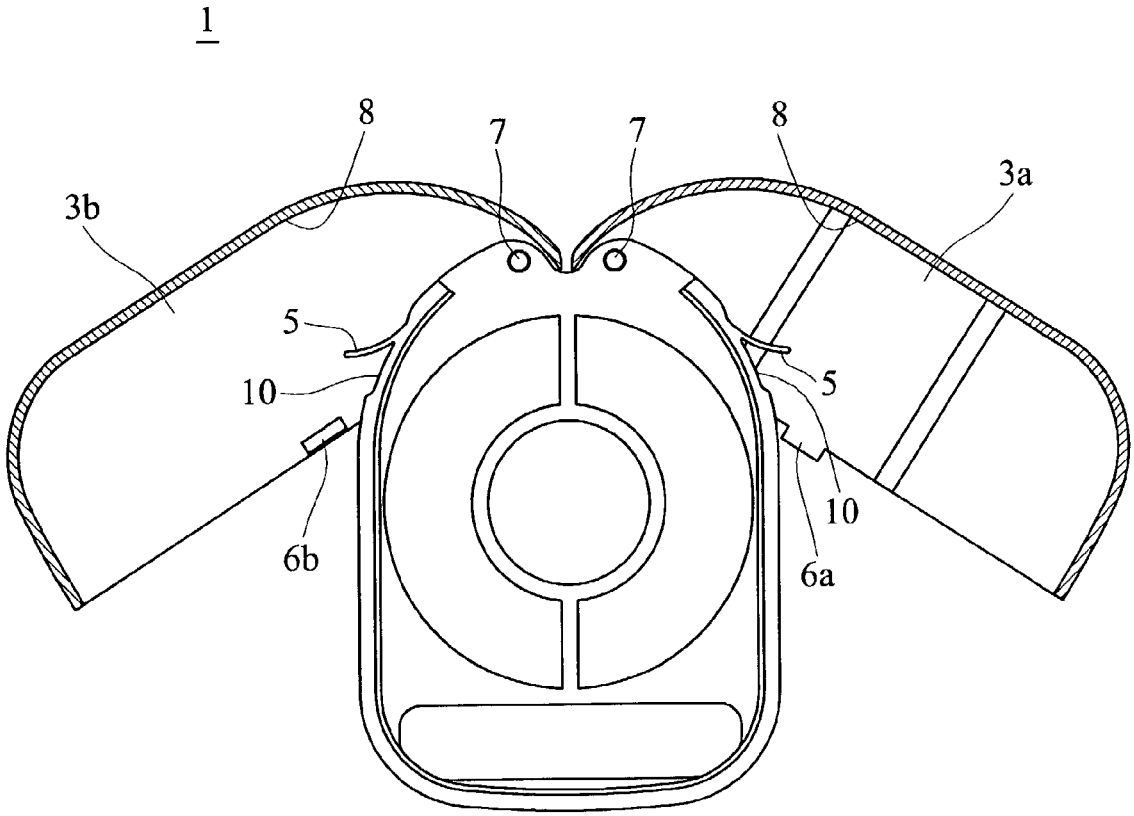
FIG. 5 is a top view showing an opened state of the cosmetic compact according to the embodiment of the invention.

The opening mechanism of cosmetic compact 1 that can be opened by a single hand will be described in detail with reference to accompanying drawings. FIG. 3 is a top partially sectional view showing the cosmetic compact 1 in a closed state, and FIG. 4 is an enlarged cross-sectional view along line "A—A" in FIG. 3. FIG. 5 is a top view showing an opened state of the cosmetic compact 1.

As shown in FIGS. 3 and 4, latch structure 6 is formed on the interface where covers 3*a* and 3*b* contact with each other upon closing the cosmetic compact 1. According to this embodiment, the latch structure 6 includes a first hook 6*a* formed on the first cover 3*a*, and a second hook 6*b* formed on the second cover 3*b* that is disposed in mating engagement with the first cover 3*a*. As shown in FIG. 3, the first cover 3*a* and the second cover 3*b* are pivotally connected to the base member 2, respectively, by means of a pair of hinge pins 7. In a closed state of the cosmetic compact 1, the first hook 6*a* engages with the second hook 6*b*, and the pair of covers 3*a*, 3*b* are kept in a closed position. At the same time, flexible members 5 that are compressed by the side walls 8 of the covers 3*a*, 3*b* closely contact with both sides of base member 2. As shown in FIG. 4, upon clicking a raised portion 9 formed on the covers by one hand, first hook 6*a* of the first cover 3*a* moves downwardly, so as to slide out of engagement with second hook 6*b*. At this time, flexible members 5 that are formerly compressed are released and thus a resilient force is produced and acts upon the side walls 8 to open the covers 3*a* and 3*b*, which allows the cosmetic compact to be opened as shown in FIG. 5. It is to be noted that with the release of the flexible members 5, the covers 3*a* and 3*b* open at the same time.

As described above, due to the fact that the flexible members 5 coact with the latch structure 6*a* and 6*b*, and the covers 3*a* and 3*b* are configured in pair, a user can open compact 1 with a single hand. Therefore, it is convenient for a user to use the compact 1 of the invention.

Moreover, on both sides of the base member 2 can be formed with notches 10 for accommodating flexible members 5 upon their being compressed by the side walls 8 of covers 3*a*, 3*b*.

Further, the flexible members 5 and the latch structure 6*a*, 6*b* can be integrally formed on the base member 2 and covers 3*a*, 3*b*, respectively, in order to simplify the manufacturing process, so that the compact 1 of the invention is suitable for mass production.

While the invention has been described by way of examples and in terms of an embodiment, it is to be understood that the invention is not limited to the disclosed embodiment. Therefore, the scope of the appended claims should be accorded the broadest interpretation so as to encompass all equivalent modifications.

What is claimed is:

1. A compact case, comprising:

a base member;

a pair of covers each pivotally connected to the base member;

a plurality of flexible members attached to both sides of the base member for producing a resilient force to open the pair of covers simultaneously; and at least one latch structure formed on the pair of covers.

2. The compact case according to claim 1, wherein the base member has a plurality of recesses.

3. The compact case according to claim 1, wherein the plurality of flexible members are leaf springs.

4. The compact case according to claim 1, wherein on both sides of the base member are formed with notches for accommodating the plurality of flexible members when the plurality of flexible members are compressed.

5. The compact case according to claim 1, wherein a raised portion is formed on the pair of covers where the latch structure is formed.

6. The compact case according to claim 1, wherein the flexible members are integrally formed on the base member.

7. The compact case according to claim 1, wherein the latch structure is integrally formed on the pair of covers.

* * * * *